US006621021B2

(12) United States Patent
Pechhold et al.

(10) Patent No.: US 6,621,021 B2
(45) Date of Patent: Sep. 16, 2003

(54) DIFFERENTIAL PRESSURE SWITCH AND SENSOR

(75) Inventors: Frank Pechhold, Ludwigsburg (DE); Arno Marto, Weil der Stadt (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/309,044

(22) Filed: Dec. 4, 2002

(65) Prior Publication Data

US 2003/0102203 A1 Jun. 5, 2003

(51) Int. Cl.[7] ..... H01H 35/24
(52) U.S. Cl. ..... 200/83 A; 200/83 R; 200/83 J
(58) Field of Search ..... 200/82 R, 82 A, 200/83 R–83 C, 83 J, 83 P, 83 S, 83 SA

(56) References Cited

U.S. PATENT DOCUMENTS

| | | | | |
|---|---|---|---|---|
| 2,468,768 A | | 5/1949 | Malick | 177/311 |
| 4,339,955 A | | 7/1982 | Iwasaki | 73/728 |
| 4,460,812 A | | 7/1984 | Asahi | 200/83 J |
| 4,503,301 A | | 3/1985 | Kurtz | 200/83 D |
| 4,644,116 A | * | 2/1987 | Miyakawa | 200/83 R |
| 4,654,643 A | | 3/1987 | Meisenheimer | 340/626 |
| 4,703,140 A | * | 10/1987 | Poling | 200/83 P |
| 4,767,898 A | * | 8/1988 | Yasuda et al. | 200/83 R |
| 5,216,213 A | * | 6/1993 | Sato | 200/83 R |
| 5,373,127 A | * | 12/1994 | Homol | 200/83 J |
| 5,538,185 A | * | 7/1996 | Rabitsch et al. | 239/76 |

FOREIGN PATENT DOCUMENTS

| | | | |
|---|---|---|---|
| DE | 44 14 739 A1 | 11/1994 | B05B/7/12 |
| DE | 1947 575 U1 | 10/1996 | |
| EP | 0 676 785 | 10/1995 | H01H/35/34 |

* cited by examiner

*Primary Examiner*—Michael Friedhofer
(74) *Attorney, Agent, or Firm*—Nixon Peabody LLP; David S. Safran

(57) ABSTRACT

A differential pressure switch having a piston which is guided in a piston housing in a cylinder bore against the force of a return element, the piston head having a pressure $P_1$ applied to it, while a bore space around its tapered piston shaft has a pressure $P_2$ applied to it. A switching process is triggered by movement of the piston, the piston tip acting on a switching element and being sealed in relation to the cylinder bore by a rolling diaphragm which is movable within the range of axial movement of the piston.

12 Claims, 1 Drawing Sheet

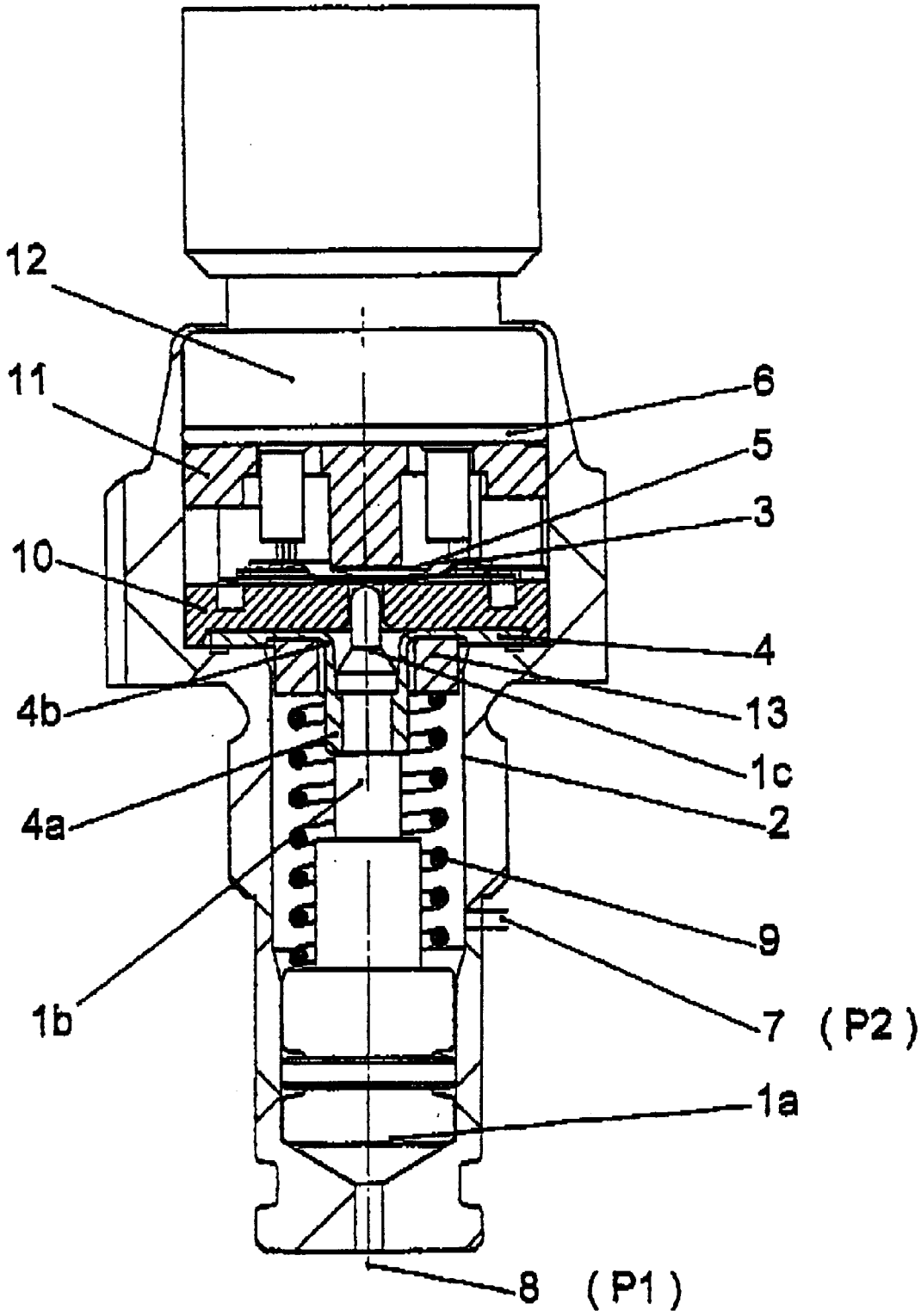
12
11
10
4b
4a
1b
6
5
3
4
13
1c
2
9
7 (P2)
1a
8 (P1)

DIFFERENTIAL PRESSURE SWITCH AND SENSOR

BACKGROUND OF THE INVENTION

1. Field of the Invention

The present invention relates to a differential pressure switch having a piston, which is guided in a cylinder bore of a piston housing against the force of a return element, the piston head having a pressure $P_1$ applied to it, while the bore space around a tapered shaft of the piston has a pressure $P_2$ applied to it, a switching process being triggered by movement of the piston.

2. Description of Related Art

The previously known differential pressure switches have the disadvantage that the switching process is performed using a piston and switching element that is located in the liquid or gaseous medium whose pressure is to be measured or whose pressure is to be used for switching.

SUMMARY OF THE INVENTION

The primary object of the present invention is to provide a differential pressure switch and/or sensor in which the actual switching or display process occurs uninfluenced by the type, temperature, and/or pressure of the medium being measured or sensed.

It is a further object to provide differential pressure switch and/or sensor which will attain the foregoing object, yet can be constructed simply and cost-effectively, and in this case, will suppress the penetration of moisture in order to avoid the occurrence of error or leakage currents, in the region of the switching element, which may impair the switching processes.

The objects according to the present invention are achieved by a differential pressure switch, which may be implemented in the same way as a differential pressure sensor, in which the piston tip, which cooperates with a switching element, is sealed in relation to the cylinder bore by a rolling diaphragm, which is movable within the range of the axial movement of the piston.

The an embodiment of the present invention is described in more detail below with reference to the accompanying drawings.

BRIEF DESCRIPTION OF THE DRAWINGS

The sole FIGURE of the drawings is a schematic longitudinal sectional view of a preferred embodiment of a differential pressure switch according to the present invention.

DETAILED DESCRIPTION OF THE DRAWINGS

In the illustrated preferred embodiment, a piston is positioned in a cylinder bore 2, together with a spring 9 which functions as a return element.

Piston head 1*a* is exposed to a medium, at a pressure $P_1$, in a space, chamber or line 8; this space may, for example, be the intake side of a medium filter.

The region of bore 2 around a tapered (stepwise reduced in diameter) piston shaft 1*b* is connected via a line 7 to a medium at a pressure $P_2$, this may be the connection to the clean side of the medium filter mentioned. If pressure $P_1$ of the medium increases in comparison to pressure $P_2$, piston 1 is set into motion in the axial direction; if the differential pressure falls, piston 1 is moved back into its starting position by spring 9.

Piston tip 1*c*, which cooperates with a switching element 3, for example, a spring element and which triggers the switching and/or display process of a switching member 10/11, is sealed in relation to the medium at pressure $P_2$.

In the present embodiment, a funnel-shaped rolling diaphragm 4 encloses the piston region under piston tip 1*c* to form a seal. In this case, tubular region 4*a* of rolling diaphragm 4 is preferably mounted in a circular groove surrounding the piston region and is secured against axial displacement in this way. Funnel-shaped wall 4*b* of rolling diaphragm 4 is guided out of the end region of the bore to seal the cylinder bore. In this case, it may be movably positioned and implemented to a degree which corresponds to the maximum axial piston movement, without impairing this movement. This is made possible in that the preferably slightly conical wall 4*b* of rolling diaphragm 4 may unroll in the free space. It is also possible that the axial extensibility of the material of rolling diaphragm region 4*b* corresponds to these requirements, the arrangement of rolling diaphragm region 4*b* then not having to be movable.

Return spring 9 presses against an adjustment disk 13 to apply a return force. The switching member has an upper part 11 and a lower part 10 (as a spacer disk), having internal sensors, contacts, etc., which are known per se, and thus, by themselves, are not part of the present invention. A plug housing 12 and the switching element 10/11 are connected via an O-ring gasket 6; in this way, the switching space is sealed off from the surroundings in accordance with Standard IP 67.

In the differential pressure switch and/or pressure sensor according to the present invention, rolling diaphragm 4 permits the axial movement of piston 1, while simultaneously sealing switching and/or display region 5, i.e., the region surrounding piston tip 1*c*, in relation to cylinder bore 2 and the medium located therein.

What is claimed is:

1. A differential pressure switch comprising:

a piston housing having a cylinder bore therein;

a piston having a piston head at one end, a piston tip at an opposite second end, and a tapered piston shaft between the piston head and the piston tip, the piston being guided for reciprocal movement in the cylinder bore of the piston housing;

a switch element, switching of which being triggered by movement of the piston and a return element for applying a return force toward the piston head of the piston;

wherein the piston head has a pressure $P_1$ applied to it and a bore space of the cylinder bore around the tapered piston shaft has a pressure $P_2$ applied to it;

where the piston tip is positioned to act on the switching element and is sealed off in relation to said bore space of the cylinder bore by a rolling diaphragm which is movable within a range of said movement of the piston.

2. The differential pressure switch according to claim 1, wherein the rolling diaphragm has a funnel-shaped, tubular region which encloses the piston shaft below the piston tip by abutting against it radially, while a region of the rolling diaphragm which has a funnel-shaped wall is positioned in a bore region which surrounds the piston tip, the diaphragm sealing the bore space of the cylinder bore in relation to said bore region.

3. The differential pressure switch according to claim 2, wherein the switch element is a spring contact.

4. The differential pressure switch according to claim 3, wherein the rolling diaphragm is impermeable to at least one of liquids and gases.

5. The differential pressure switch according to claim 4, wherein the rolling diaphragm is made of at least one elastomeric material, said at least one elastomeric material being temperature stable and inert in relation to a media to be measured.

6. The differential pressure switch according to claim 5, wherein the return element acts on an adjustment disk which adjusts the return force of the return element.

7. The differential pressure switch according to claim 6, wherein a sealing O-ring is positioned between the plug housing and the switching element.

8. The differential pressure switch according to claim 1, wherein the switch element is a spring contact.

9. The differential pressure switch according to claim 1, wherein the rolling diaphragm is impermeable to at least one of liquids and gases.

10. The differential pressure switch according to claim 9, wherein the rolling diaphragm is made of at least one elastomeric material, said at least one elastomeric material being temperature stable and inert in relation to a media to be measured.

11. The differential pressure switch according to claim 1, wherein the return element acts on an adjustment disk which adjusts the return force of the return element.

12. The differential pressure switch according to claim 1, wherein a sealing O-ring is positioned between a plug housing and the switch element.

* * * * *

UNITED STATES PATENT AND TRADEMARK OFFICE

CERTIFICATE OF CORRECTION

PATENT NO. : 6,621,021 B2
DATED : September 16, 2003
INVENTOR(S) : Frank Pechhold et al.

It is certified that error appears in the above-identified patent and that said Letters Patent is hereby corrected as shown below:

Title page,
Item [30], Foreign Application Priority Data, insert -- December 5, 2001 (DE) 101 59 536.0 --

Signed and Sealed this

Eleventh Day of May, 2004

JON W. DUDAS
*Acting Director of the United States Patent and Trademark Office*